US006152417A

United States Patent [19]

Randall

[11] Patent Number: 6,152,417

[45] Date of Patent: Nov. 28, 2000

[54] READING AND WRITING BED EASEL

[76] Inventor: Sarah B. Randall, 161 Hoffman Ave., Unit #3, Cranston, R.I. 02920

[21] Appl. No.: 09/292,589

[22] Filed: Apr. 15, 1999

[51] Int. Cl.[7] ..... A47B 97/04

[52] U.S. Cl. ..... 248/460; 108/43; 248/439; 248/456

[58] Field of Search ..... 248/460, 441.1, 248/444, 446, 447, 451, 452, 453, 454, 455; 108/43, 34, 35, 36, 166, 167, 171, 179, 190, 147.19, 132, 125, 126

[56] References Cited

U.S. PATENT DOCUMENTS

| | | | |
|---|---|---|---|
| 1,766,616 | 6/1930 | Faris | 108/9 |
| 1,851,600 | 3/1932 | Stanley | 108/43 |
| 2,003,241 | 5/1935 | Brown | 248/439 |
| 2,509,060 | 5/1950 | Hoder | 108/45 |
| 5,054,736 | 10/1991 | Champoux | 248/444 |
| 5,265,541 | 11/1993 | Gordon | 108/34 |
| 5,383,411 | 1/1995 | Tomaka et al. | 108/129 |
| 5,598,786 | 2/1997 | Patterson | 108/43 |
| 5,722,628 | 3/1998 | Menaged | 248/441.1 |
| 5,829,787 | 11/1998 | Newhouse, Jr. | 248/451 X |
| 5,833,200 | 11/1998 | Patterson | 248/456 |

*Primary Examiner*—Anita M. King

[57] ABSTRACT

A portable easel is provided including a base and a leg assembly including a pair of collapsible legs mounted on the base for supporting the same. Also included is a plate hingably coupled to the base for being selectively angled with respect to the base to support reading and writing material.

10 Claims, 2 Drawing Sheets

READING AND WRITING BED EASEL

BACKGROUND OF THE INVENTION

1. Field of the Invention

The present invention relates to easels and more particularly pertains to a new reading and writing bed easel for conveniently reading or writing within a bed or the like.

2. Description of the Prior Art

The use of easels is known in the prior art. More specifically, easels heretofore devised and utilized are known to consist basically of familiar, expected and obvious structural configurations, notwithstanding the myriad of designs encompassed by the crowded prior art which have been developed for the fulfillment of countless objectives and requirements.

Known prior art easels include U. S. Pat. No. 5,265,541; U.S. Pat. No. 4,718,630; U.S. Pat. No. 5,054,736; U.S. Pat. No. Des. 355,786; U.S. Pat. No. 2,975,544; and U.S. Pat. No. 1,305,853.

In these respects, the reading and writing bed easel according to the present invention substantially departs from the conventional concepts and designs of the prior art, and in so doing provides an apparatus primarily developed for the purpose of conveniently reading or writing within a bed or the like.

SUMMARY OF THE INVENTION

In view of the foregoing disadvantages inherent in the known types of easels now present in the prior art, the present invention provides a new reading and writing bed easel construction wherein the same can be utilized for conveniently reading or writing within a bed or the like.

The general purpose of the present invention, which will be described subsequently in greater detail, is to provide a new reading and writing bed easel apparatus and method which has many of the advantages of the easels mentioned heretofore and many novel features that result in a new reading and writing bed easel which is not anticipated, rendered obvious, suggested, or even implied by any of the prior art easels, either alone or in any combination thereof.

To attain this, the present invention generally comprises a base with a substantially planar rectangular configuration defined by a top face, a bottom face, and a periphery formed therebetween. Such periphery has a pair of opposed side edges each having a pair of channel defining lips depending therefrom. Such lips each have an inverted L-shaped configuration. As shown in FIG. 3, the top face of the base has a pair of linearly aligned rows of circular recesses formed therein between the opposed side edges of the base. Such recesses are positioned adjacent to a first one of the opposed side edges. An elongated slot is provided with an inverted T-shaped cross-section formed therein between the opposed side edges of the base adjacent one of the rows of recesses. Next provided is a pair of legs each having a substantially planar rectangular configuration. A bottom edge of each leg has a semi-circular cut out formed therein. A top edge of each leg has a pair of dowels extending outwardly from ends thereof for being slidably received within the channel of the base to selectively support the base. Also included is a plate with a substantially planar rectangular configuration divided into a pair of lateral halves. Such halves are preferably hingably coupled with respect to each other. For supporting reading material, a lower lip extends from a bottom edge of each of the halves. A closed loop handle is mounted to a side edge of one of the halves. Further, an inverted T-shaped tab is coupled to an intermediate extent of the bottom edge of one of the halves and depends downwardly therefrom. In use, the inverted T-shaped tab is adapted for being slidably positioned within the slot of the base. As shown in FIGS. 1 & 3, a support assembly includes an inverted V-shaped stand with a pair of disk-shaped feet mounted to bottom ends thereof. Such feet are configured for being removably positioned within a pair of the recesses of the base. The inverted V-shaped stand has an apex with a ball mounted thereon for being pivotally received within a socket formed on a rear face of the plate. Finally, a page clip includes a pair of resilient wires each having a pair of coupled ends and a pair of free ends. The free ends each have a circular loop formed thereon. The wires are maintained in parallel and are defined by a pair of perpendicular linear portions and an areuate portion. The page clip may thus be used to hold a sheet of paper or the like on the plate. Finally, a page viewer is provided including a bracket with a substantially planar rectangular front face having a cut out formed therein to define a frame. An arcuate rear face is coupled to the front face and maintained in parallel relationship therewith. Further, a plurality of lenses are provided each with a substantially planar rectangular configuration for being snappily received within the frame.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new reading and writing bed easel apparatus and method which has many of the advantages of the easels mentioned heretofore and many novel features that result in a new reading and writing bed easel which is not anticipated, rendered obvious, suggested, or even implied by any of the prior art easels, either alone or in any combination thereof.

It is another object of the present invention to provide a new reading and writing bed easel which may be easily and efficiently manufactured and marketed.

It is a further object of the present invention to provide a new reading and writing bed easel which is of a durable and reliable construction.

An even further object of the present invention is to provide a new reading and writing bed easel which is susceptible of a low cost of manufacture with regard to both materials and labor, and which accordingly is then susceptible of low prices of sale to the consuming public, thereby making such reading and writing bed easel economically available to the buying public.

Still yet another object of the present invention is to provide a new reading and writing bed easel which provides in the apparatuses and methods of the prior art some of the advantages thereof while simultaneously overcoming some of the disadvantages normally associated therewith.

Still another object of the present invention is to provide a new reading and writing bed easel for conveniently reading or writing within a bed or the like.

Even still another object of the present invention is to provide a new reading and writing bed easel that includes a base and a leg assembly including a pair of collapsible legs mounted on the base for supporting the same. Also included is a plate hingably coupled to the base for being selectively angled with respect to the base to support reading and writing material.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
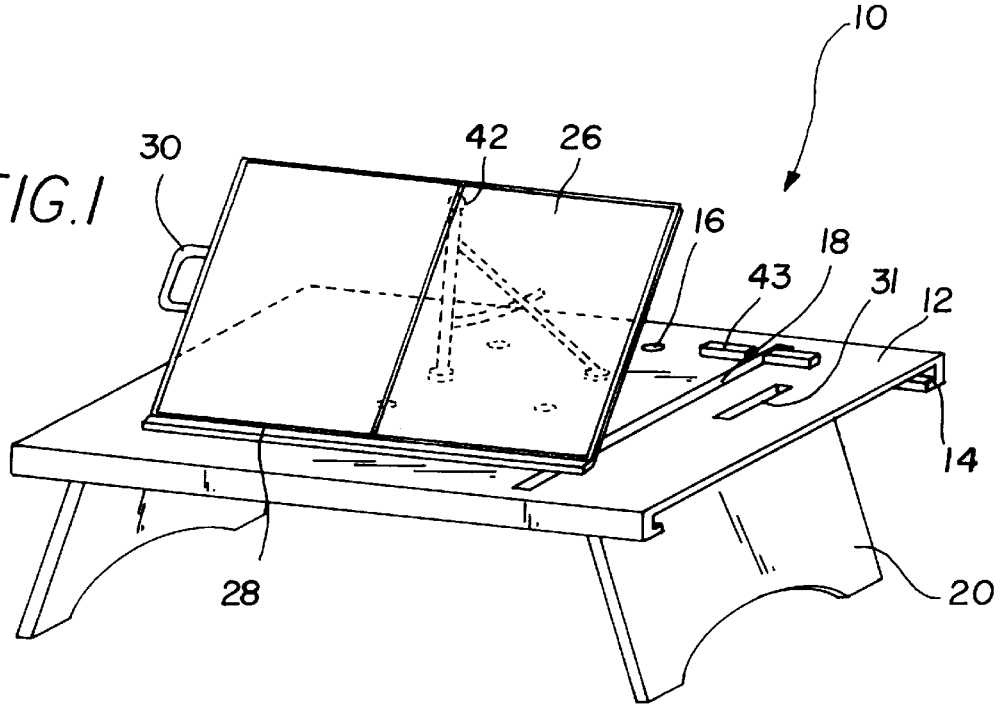
FIG. 1 is a perspective view of a new reading and writing bed easel according to the present invention.
Figure 2:
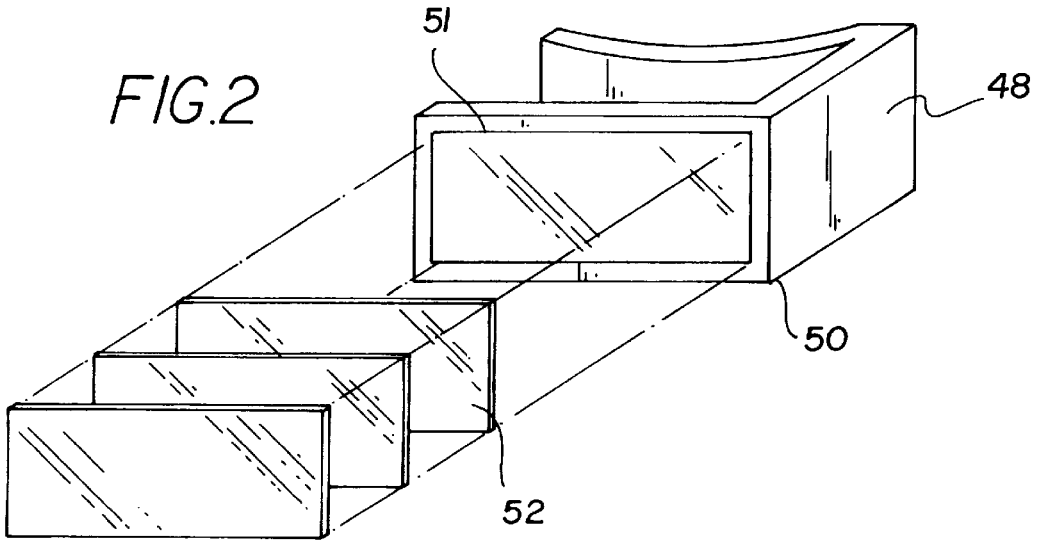
FIG. 2 is a side view of one viewing piece of the present invention.
Figure 3:
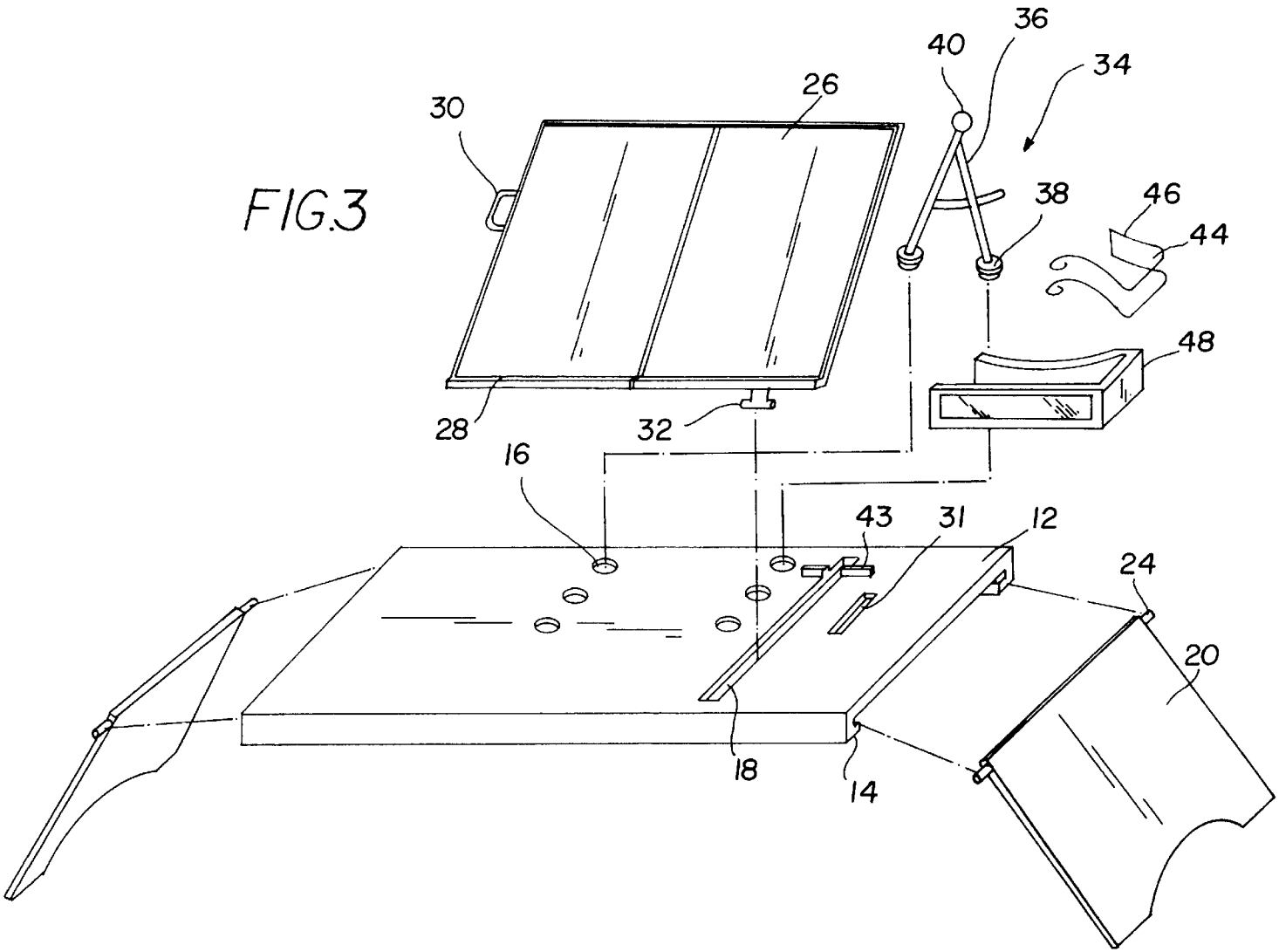
FIG. 3 is an exploded perspective view of the present invention.

With reference now to the drawings, and in particular to FIGS. 1 through 3 thereof, a new reading and writing bed easel embodying the principles and concepts of the present invention and generally designated by the reference numeral 10 will be described.

The present invention, designated as numeral 10, includes a base 12 with a substantially planar rectangular configuration defined by a top face, a bottom face, and a periphery formed therebetween. Such periphery has a pair of opposed side edges each having a pair of channel defining lips 14 depending therefrom. Such lips each have an inverted L-shaped configuration. As shown in FIG. 3, the top face of the base has a pair of linearly aligned rows of circular recesses 16 formed therein between the opposed side edges of the base. Such recesses are positioned adjacent to a first one of the opposed side edges. An elongated slot 18 is provided with an inverted T-shaped cross-section formed therein between the opposed side edges of the base adjacent one of the rows of recesses.

Next provided is a pair of legs 20 each having a substantially planar rectangular configuration. A bottom edge of each leg has a semi-circular cut out formed therein. A top edge of each leg has a pair of dowels 24 extending outwardly from ends thereof for being slidably and pivotally received within the channel of the base to selectively support the base. Ideally, the dowels are frictionally engaged within the channel to an extent sufficient to maintain the base upright during use.

Also included is a plate 26 with a substantially planar rectangular configuration divided into a pair of lateral halves. Such halves are preferably hingably coupled with respect to each other. For supporting reading material, a lower lip 28 extends from a bottom edge of each of the halves. A closed loop carrying handle 30 is mounted to a side edge of one of the halves. In the alternative, the handle may be replaced with a snap for being removably coupled to a slit 31 formed in the base to maintain the base and folded plate in fixed relative relationship. Further, an inverted T-shaped tab 32 is coupled to an intermediate extent of the bottom edge of one of the halves and depends downwardly therefrom. In use, the inverted T-shaped tab is adapted for being slidably positioned within the slot of the base.

As shown in FIGS. 1 & 3, a support assembly 34 includes an inverted V-shaped stand 36 with a pair of disk-shaped feet 38 mounted to bottom ends thereof. Such feet are configured for being removably positioned within a pair of the recesses of the base. The inverted V-shaped stand has an apex with a ball 40 mounted thereon for being pivotally received within a socket 42 formed on a rear face of the plate. In use, the plate may be selectively angled. Ideally, a pair of stops 43 flank a rear end of the groove in line with a rearmost pair of the recesses for preventing the plate from being slid back past a certain amount.

Finally, a page clip 44 includes a pair of resilient wires 46 each having a pair of coupled ends and a pair of free ends. The free ends each have a circular loop formed thereon. The wires are maintained in parallel and are defined by a pair of perpendicular linear portions and an arcuate portion. The page clip may thus be used to hold a sheet of paper or the like on the plate.

Finally, a page viewer 48 is provided including a bracket 50 with a substantially planar rectangular front face having a cut out 51 formed therein to define a frame. An arcuate rear face is coupled to the front face and maintained in parallel relationship therewith. Further, a plurality of lenses 52 are provided each with a substantially planar rectangular configuration for being snappily received within the frame. Each of the lenses preferably has a unique magnification associated therewith.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable reading and writing easel comprising, in combination:

a base with a substantially planar rectangular configuration defined by a top face, a bottom face, and a periphery formed therebetween, opposed side edges of the base each having a pair of channel-defining lips depending therefrom each having an inverted L-shaped configuration, the top face of the base having a pair of linearly aligned rows of circular recesses formed therein between the opposed side edges of the base and adjacent to a first one of the opposed side edges, and an elongated slot with an inverted T-shaped cross-section formed therein between the opposed side edges of the base adjacent one of the rows of recesses;

a pair of legs each having a substantially planar rectangular configuration with a bottom edge having a semicircular cut out formed therein and a top edge having a pair of dowels extending outwardly form ends thereof for being slidably received within the channel-defining lips of the base to selectively support the base;

a plate with a substantially planar rectangular configuration divided into a pair of lateral halves hingably coupled with respect to each other, a lower lip extending from a bottom edge of each of the halves, a closed loop handle mounted to a side edge of one of the halves, and an inverted T-shaped tab coupled to an intermediate extent of the bottom edge of one of the halves and depending downwardly therefrom for being slidably positioned within the slot of the base;

a support assembly including an inverted V-shaped stand with a pair of disk-shaped feet mounted to bottom ends of the stand for being removably positioned within a pair of the recesses of the base, the inverted V-shaped stand has an apex with a ball mounted thereon for being pivotally received within a socket formed on a rear face of the plate;

a page clip including a pair of resilient wires each having a pair of coupled ends and a pair of free ends, the free ends each having a circular loop formed thereon, wherein the wires are maintained in parallel and are defined by a pair of perpendicular linear portions and an arcuate portion; and a page viewer including a bracket with a substantially planar rectangular front face with a cut out formed therein to define a frame, an arcuate rear face coupled to the front face and maintained in parallel relationship therewith, and a plurality of lenses each with having a substantially planar rectangular configuration for being snappily received with the frame.

2. A portable easel comprising:

a base having an upper surface, the upper surface of the base having an elongated slot formed therein, the elongated slot extending between side edges of the base, the elongated slot having an inverted T-shaped cross-section taken transverse to the length of the elongated slot a leg assembly including a pair of collapsible legs mounted on the base for supporting the base; and a plate having a bottom edge, an inverted T-shaped tab coupled to the bottom edge and depending downwardly from the bottom edge, the T-shaped tab being slidably positioned in the slot of the base for slidably coupling the bottom edge of the plate to the upper surface of the base for permitting selective positioning of the bottom edge of the plate with respect to the base.

3. A portable easel as set forth in claim 2 wherein the leg assemblies are slidably received within a channel formed in the base.

4. A portable easel as set forth in claim 2 wherein the plate is selectively elevated by way of a support.

5. A portable easel as set forth in claim 4 wherein a plurality of linearly aligned recesses are formed in the base for receiving legs of the support and positioning the plate at a selected angle.

6. A portable easel as set forth in claim 2 and further including a magnifying member removably mounted on the plate.

7. A portable easel as set forth in claim 2 wherein the plate includes a pair of hingably coupled halves.

8. A portable reading and writing easel comprising:

a base defined by a top face, a bottom face, and a periphery formed therebetween, opposed side edges of the base each having a pair of channel-defining lips depending therefrom, each of the channel-defining lips having an inverted L-shaped configuration, the top face of the base having a plurality of recesses formed therein between the opposed side edges of the base and adjacent to a first one of the opposed side edges, and an elongated slot being formed in the base between the opposed side edges of the base;

a pair of legs each having a substantially planar configuration with a bottom edge and a top edge having a pair of dowels extending outwardly from end thereof for being slidably received in the channel-defining lips of the base to selectively support the base;

a plate divided into a pair of lateral halves pivotally coupled together, a lower lip extending from a bottom edge of each of the halves, and an inverted T-shaped tab coupled to the bottom edge of one of the halves and depending downwardly from the half for being slidably positioned in the slot of the base;

a support assembly including an inverted V-shaped stand with a pair of feet mounted to bottom ends of the stand, the feet being adapted for being removably positioned in a pair of the recesses of the base, the inverted V-shaped stand having an apex with a ball mounted thereon for being pivotally received in a socket formed on a rear face of the plate; and a page viewer including a bracket with a front face with a cut out formed therein to define a frame, a rear face being coupled to the front face in a substantially parallel relationship, and a plurality of magnifying lenses adapted for being removably received in the frame.

9. The easel of claim 8 additionally comprising a closed loop handle being mounted to a side edge of one of the halves of the plate.

10. The easel of claim 8 additionally comprising a page clip including a pair of resilient wires each having a pair of coupled ends and a pair of free ends, the free ends each having a loop formed thereon, wherein the wires are maintained substantially in parallel and are defined by a pair of substantially perpendicular linear portions and an arcuate portion.

* * * * *